US009257104B1

(12) United States Patent
Cherry et al.

(10) Patent No.: US 9,257,104 B1
(45) Date of Patent: Feb. 9, 2016

(54) LAYERED WOOD AND SILK GUITAR PICKS

(71) Applicants: Patrick Cherry, Denver, CO (US); Michael Norby, Denver, CO (US)

(72) Inventors: Patrick Cherry, Denver, CO (US); Michael Norby, Denver, CO (US)

( * ) Notice: Subject to any disclaimer, the term of this patent is extended or adjusted under 35 U.S.C. 154(b) by 0 days.

(21) Appl. No.: 14/605,736

(22) Filed: Jan. 26, 2015

(51) Int. Cl.
*G10D 3/16* (2006.01)

(52) U.S. Cl.
CPC ..... *G10D 3/163* (2013.01)

(58) Field of Classification Search
CPC ..... G10D 3/163
See application file for complete search history.

(56) References Cited

U.S. PATENT DOCUMENTS

| | | | | |
|---|---|---|---|---|
| 7,179,976 | B2 | 2/2007 | West | |
| 7,799,979 | B2 | 9/2010 | Swartz | |
| 8,017,845 | B2 | 9/2011 | Slingsby | |
| 8,110,729 | B2 | 2/2012 | Guthrie et al. | |
| 8,648,239 | B2 * | 2/2014 | Tommasi | G10D 3/163 84/322 |
| 8,742,239 | B1 * | 6/2014 | Storck | G10D 3/163 84/320 |
| 2002/0108483 | A1 * | 8/2002 | Smith | G10D 3/163 84/322 |

* cited by examiner

*Primary Examiner* — Robert W Horn
(74) *Attorney, Agent, or Firm* — Ramon L. Pizarro; Edwin H. Crabtree

(57) ABSTRACT

A composite plectrum with a strum direction is disclosed. The plectrum is generally triangular in shape and includes a first layer of wood having a first grain direction, a layer of silk fabric with silk threads that are woven at angles to one another, and a second layer of wood with a grain in a second grain direction. The second layer of wood being adhered to the layer of silk while at 90 degrees to the first layer of wood, so that the layer of silk extends between the two layers of wood and is adhered to both layers of wood.

2 Claims, 2 Drawing Sheets

*Actual recording using a La Luna Hardwood pick*

*Actual recording using a plastic pick*

LAYERED WOOD AND SILK GUITAR PICKS

REFERENCE TO RELATED APPLICATIONS

This application claims the benefit of my provisional application having Ser. No. 61/931,541, titled "LAYERED WOOD AND SILK GUITAR PICKS" filed Feb. 24, 2014, which is incorporated herein by reference in its entirety.

BACKGROUND OF THE INVENTION

(a) Field of the Invention

This invention generally relates to a device and a process blends that uses hardwoods such as rosewood, tiger wood, and cocobolo, to create unique plectrums.

The process begins with micro-thin layers of wood, and the an additional internal layer of natural fiber for strength and binding, increasing the resiliency, yet enabling a thinner playing surface. Every pick surface is hand scraped for better adhesion and carefully joined and glued together using 1000+ pounds of pressure.

As with any natural fiber, some inconsistencies could occur from use. A few swipes of the pick with a fine-grain emery board will smooth any rough edges.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
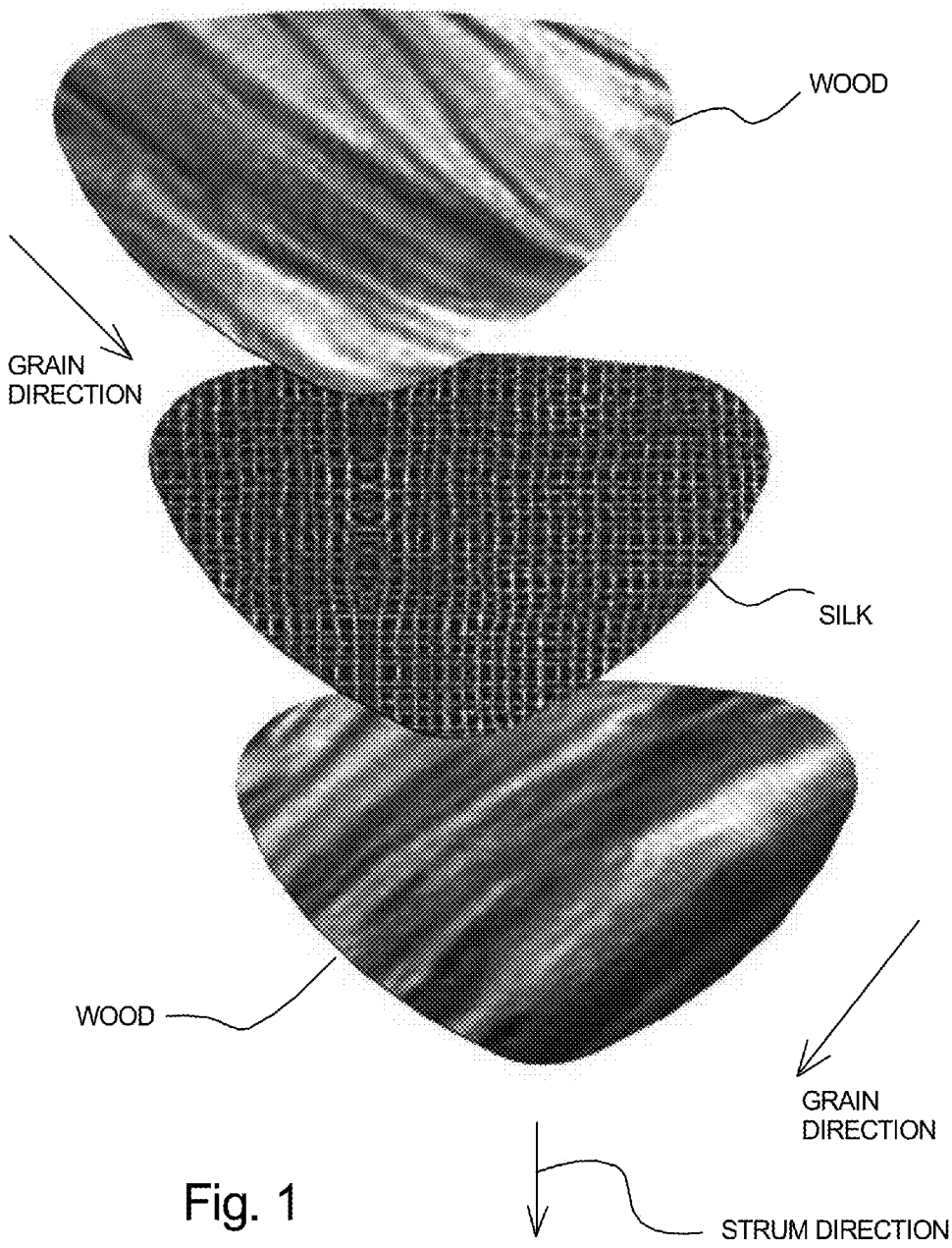
FIG. 1 shows the layering of an embodiment of the invention as well as the grain orientation of the wood and the weave orientation of the silk fabric used in a highly preferred embodiment of the invention.

The preferred embodiment of the plectrums, or picks, disclosed here is a three-layer lamination as shown in FIG. 1. A top and a bottom layer of natural wood, with wood grain in a grain direction is used. Thus the wood, will be non-composite, such as plywood or particle board composites, is used. Between the top layer The outside layers are preferably single unitary, one piece, layers of wood veneers approximately 1/32" thick.

The center layer is a natural fiber woven silk cloth that is glued with an epoxy resin and is oriented in line with the strum direction.

Front and back veneers are angled 45 degrees relative to the strum direction and 90 degrees to each other. This provides an even flex in all directions and prevents natural bend lines from becoming break lines.

The veneer layers are infused with a water-based resin that seals the grain lines and makes the wood more flexible and moisture and abrasion resistant.

The picks get a finishing coat with a tree nut based oil that prevents the picks from drying out and becoming brittle.

Wood will generally break along a grain line if bent too far. To minimize the chances of breakage and to provide an even bend in all directions, the top and bottom layers are angled 90 degrees to each other. For a layer to bend, one side must compress and one side must stretch. Laminated, cross glued layers limit bending and therefore breakage because wood resists the length changes that are require for bending at the glue line.

The center fiber layer acts as a membrane that distributes bending forces along its length, limiting how far each layer can bend and adding a dynamic tension that, when flexed, gives the pick a quick-responding rebound energy.

The basic construction method uses two layers of wood veneer that are glued with a flexible epoxy resin or other suitable binder, such as a thermoplastic material. A layer of reenforcing fabric is placed between in the two layers of wood and the entire assembly is held together by the resin.

Experimentation with various types of fabrics including carbon fiber, fiberglass, nylon, polyester and silk revealed that carbon and fiberglass were structurally sound, but could not be used as part of a guitar pick due to the fact that the stiff glass or carbon fibers would break off with wear against the strings, and tiny amounts of irritating glasslike fibers were released. Also, the stiffness imparted by glass and carbon fibers resulted in picks that were too stiff. It may be possible to overcome the problems with the stiffness of glass and graphite fiber by using very small diameter fibers, but the problem of the creation of irritating chards of fiber during use will still be a problem.

In a situation where producing irritating fibers isn't an issue, blank sheets produced with this method and using carbon fiber or fiberglass are highly flexible and strong for their thickness and weight. They can be bent and twisted into complex shapes that can be very strong with very little interior structure. These panels would have flexibility and strength-per-weight advantages over veneers glued onto plywood.

Sound Recording Data

Figure 2:
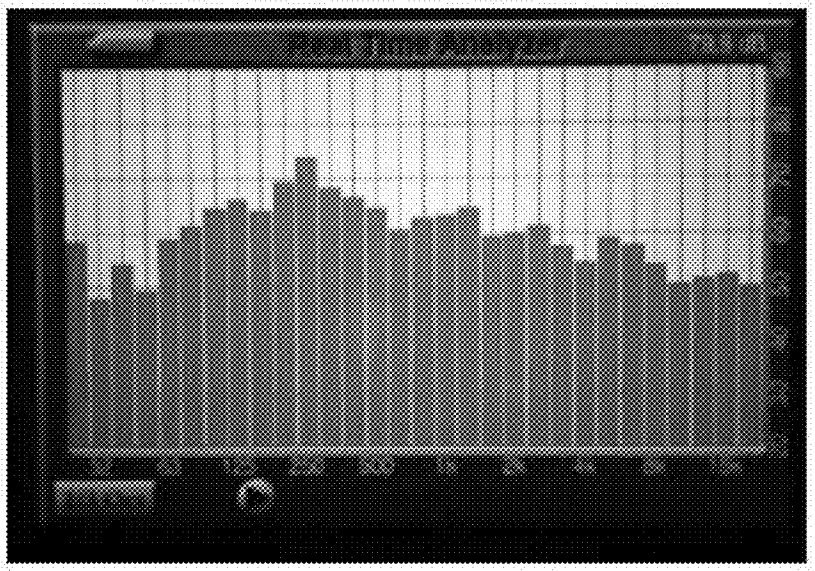
FIG. 2 shows a chart comparing the sound response of a stringed musical instrument strummed with a conventional plastic pick and a "La Luna" pick made in accordance with the disclosed invention.
Figure 2:
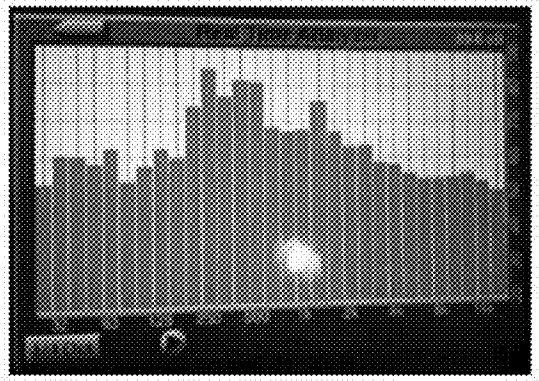

Many sound engineers reduce the treble during recordings to compensate for the "click" of traditional plastic picks against metal guitar or mandolin strings. Working in a recording studio we found that our wood picks eliminated the need for this compensation. A comparison of the spectrum generated with a plastic pick and the spectrum of the same instrument using the disclosed invention (referred to as a "La Luna Hardwood" pick) is shown in FIG. 2. A warmer more natural tone came from our wood picks, resulting in a more accurate sound recording.

STEPS TO PRODUCE PICKS

1. Inspect veneers and cut to workable lengths;
2. Water wet veneers and clamp between boards to flatten. Allow to dry (1-2 days);
3. Scrape any large milling defects from gluing side of veneers;
4. Straightline edges and tape together into final size sheets;
5. Cut out an appropriately sized piece of woven reinforcing fabric;
6. Mix epoxy and apply to gluing side of two veneer sheets, one oriented horizontally and one vertically;

7. Place fabric between sheets and place this group between plywood layers and clamp using approximately 20,000 pounds of pressure per square foot;
8. Unclamp and cut to final working size;
9. Scrape and sand surfaces of gluded-up blank;
10. Force a water-based, one-part resin into the surface of the blanks;
11. Resand surfaces;
12. Oil surfaces with a tree nut based oil and let dry (8 hrs)—repeat twice;
13. Lightly sand and repeat oiling;
14. Cut out final pick shapes using a lazer cutter;
15. Bevel and soften edges with fine grit sand paper
16. Oil finished picks (let dry two days).

It has also been discovered that the use of a silk fabric backing on the unitary, one-piece, wood veneer material with a flexible glue or resin creates a particularly strong assembly that can be used as a veneer that resists cracking and splintering while cutting. Thus, the assembly results in very thin wood veneers can be used against surfaces with compound curvatures.

Thus it can be appreciated that the above-described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

We claim:

1. A composite plectrum with a strum direction, the plectrum comprising:

a first layer of wood having a grain in a first grain direction;

a layer of silk fabric comprising silk threads that are woven at first angle and threads at a second angle to one another, the layer of silk being adhered to the first layer of wood with an adhesive while maintaining threads at a first angle of the layer of silk extending along the strum direction and the grain of the first layer of wood at 45 degrees to the strum direction;

a second layer of wood, the second layer of wood having a grain in a second grain direction, the second layer of wood being adhered to the layer of silk while at 90 degrees to the first layer of wood, so that the layer of silk extends between and is adhered to the first layer of wood and to the second layer of wood.

2. A plectrum according to claim 1 wherein said plectrum is generally of a generally triangular shape with at least two sides being of approximately the same length, creating a generally isosceles triangular shape, and said strum direction is approximately normal to the base of the triangular shape of the plectrum.

* * * * *